US006473906B2

(12) United States Patent
Kambe et al.

(10) Patent No.: US 6,473,906 B2
(45) Date of Patent: Nov. 5, 2002

(54) GOLF GLOVE

(75) Inventors: Akira Kambe, Tokyo (JP); Taizo Sunagawa, Kagawa (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 12 days.

(21) Appl. No.: 09/987,398

(22) Filed: Nov. 14, 2001

(65) Prior Publication Data

US 2002/0056156 A1 May 16, 2002

(30) Foreign Application Priority Data

Nov. 14, 2000 (JP) ..... 2000-346007

(51) Int. Cl.[7] ..... A41D 19/00
(52) U.S. Cl. ..... 2/161.2; 2/159
(58) Field of Search ..... 2/16, 20, 158, 2/159, 160, 161.1, 161.2, 161.4, 161.6, 163, 169

(56) References Cited

U.S. PATENT DOCUMENTS

| | | | | |
|---|---|---|---|---|
| 3,952,333 A | | 4/1976 | Fujita | 2/161 |
| 4,164,043 A | * | 8/1979 | Fujita | 2/161.1 |
| 4,691,388 A | | 9/1987 | Boone | 2/161 |

* cited by examiner

*Primary Examiner*—Gary L. Welch
(74) *Attorney, Agent, or Firm*—Sughrue Mion, PLLC

(57) ABSTRACT

In a golf glove, a slit 5 that is laterally expanded when a hand is inserted is formed in a lower end portion of a back region 3 of the glove body 2, and engaging portions for closing the slit 5 after the hand is inserted are attached to the back region 3. An imaginary line 6 connecting the top portion 5A and the bottom portion 5B of the slit 5 does not coincide with the longitudinal axis 7 of the back region 3 of the glove body 2, but is inclined to cause the top portion 5A of the slit to be close to a little-finger portion 8 of the back region 3, and the bottom portion 5B of the slit to be close to an index-finger portion 9 of the back region 3, thereby forming the slit 5 so as to inclinedly elongate.

4 Claims, 4 Drawing Sheets

GOLF GLOVE

BACKGROUND OF THE INVENTION

1. Field of the Invention

The present invention relates to a golf glove in which a hand can be inserted and extracted very smoothly, and an excellent sense of fitness is produced when a hand is inserted into the glove.

2. Description of the Related Art

FIG. 4 shows a pre-cut body of a golf glove which has not yet been sewn, according to the related art. In the figure, 20 denotes a back region which will be used for covering the back of a hand of a golfer, 21 denotes a palm region which will be used for covering the palm of the hand, and 22 denotes a slit which is formed in a lower end portion of the back region 20, and which is laterally expanded when a hand is inserted into the glove body.

As shown in the figure, a cutting direction of the slit 22 in the golf glove according to the related art substantially coincides with the longitudinal axis 23 of the back region 20 of the glove body. Furthermore, the cutting width is approximately constant over a range from a top portion 22A to a bottom portion 22B.

Therefore, such a glove has a disadvantage that, when a hand is inserted into the glove body or extracted therefrom, the slit 22 is not largely expanded contrary to expectation, and hence inserting and extracting operations require a considerably long time. In the golf glove according to the related art, since the slit 22 is formed so as to be substantially parallel to the longitudinal axis 23 of the back region 20 of the glove body, an engaging tongue piece such as a hook-and-loop fastener or the like which is attached along the peripheral portion of the slit 22 must be pulled up in an obliquely upward direction and then engagingly fastened with another hook-and-loop fastener attached to the back region 20. As a result, a state is produced in which each of the components constituting two portions of the back region that is laterally split by the slit 22, and made of natural leather, synthetic leather, or artificial leather are partially overlapped with each other. In the case where a person wears such a glove, this state causes the wearer to feel a sense of incompatibility, thereby impairing a sense of fitness.

SUMMARY OF THE INVENTION

It is an object of the invention to provide a golf glove which can solve the above-discussed disadvantages of a golf glove according to the related art, and in which a hand can be inserted and extracted very smoothly thereinto/therefrom, and an excellent sense of fitness is produced when a hand is inserted into the glove.

The configuration of the invention for attaining the object will be described in detail. According to a first aspect of the invention, there is provided a golf glove comprising:

a back region of a glove body formed a slit, which is laterally expanded when a hand is inserted, at a lower end portion thereof; and a pair of engaging portions for closing the slit after the hand is inserted, the engaging portions provided at peripheral portions of the slit, respectively, wherein an imaginary line connecting top and bottom portions of the slit is not parallel to a longitudinal axis of the back region of the glove body;

the top portion of the slit is close to a little-finger portion of the back region;

the bottom portion of the slit is close to an index-finger portion of the back region; and one of the engaging portions is attached to the back region of the glove body to be inclined with respect to the longitudinal axis.

According to a second aspect of the invention, there is provided the golf glove according to the first aspect of the invention, wherein a side edge of the back region close to the little-finger portion is inclined with respect to the longitudinal axis.

According to a third aspect of the invention, there is provided the golf glove according to the first aspect of the invention, wherein an angle between the imaginary line and the longitudinal axis is in a range of 5° to 40°.

According to a fourth aspect of the invention, there is provided the golf glove according to the first aspect of the invention, wherein the slit has an inverted V-like shape in which a cutting width is gradually increased as advancing from the top portion toward the bottom portion.

According to a fifth aspect of the invention, there is provided the golf glove according to the fourth aspect of the invention, wherein an angle of the inverted V-like shape is in a range of 3° to 30°.

According to a sixth aspect of the invention, there is provided the golf glove according to the first aspect of the invention, wherein excess portions in vicinities of root areas of a middle-finger piece, a ring-finger piece, and a little-finger piece among components constituting a palm region of the glove body are previously removed away before sewing.

As described above, in the golf glove of the invention, the imaginary line connecting the top and bottom portions of the slit does not coincide with the longitudinal axis of the back region of the glove body, but is inclined to cause the top portion of the slit to be close to the little-finger portion of the back region, and the bottom portion of the slit to be close to an index-finger portion of the back region. Therefore, a hand can be smoothly inserted and extracted as compared with a golf glove according to the related art. In the case where the slit has an inverted V-like shape in which the cutting width is gradually increased as advancing from the top portion toward the bottom portion, when a hand is to be inserted, the slit is sufficiently laterally expanded, and hence insertion and extraction can be performed very smoothly as compared with a golf glove according to the related art.

Also an engaging tongue piece configured by a hook-and-loop fastener, a VELCRO, or the like which is sewn along the peripheral portion of the slit inclinedly elongates. When the engaging tongue piece is to be engagingly fastened with another hook-and-loop fastener, a VELCRO, or the like attached to the back region in the vicinity of the slit, therefore, each of the components constituting two portions of the back region that is laterally split by the slit can be prevented from being overlapped with each other. Thus, the wrist can be secured moderately to improve a sense of fitness when a person wears the glove.

In the case where, in addition to the configuration in which the slit formed in the back region inclinedly elongates as described above, a configuration in which excess portions in vicinities of root areas of the middle-finger piece, the ring-finger piece, and the little-finger piece among components constituting the palm region of the glove body are previously removed away before sewing is employed, it is possible to obtain an excellent sense of fitness as a whole.

DETAILED DESCRIPTION OF THE PREFERRED EMBODIMENTS

Hereinafter, a specific configuration of the golf glove of the invention will be described in detail on the basis of an illustrated embodiment.

Figure 1:
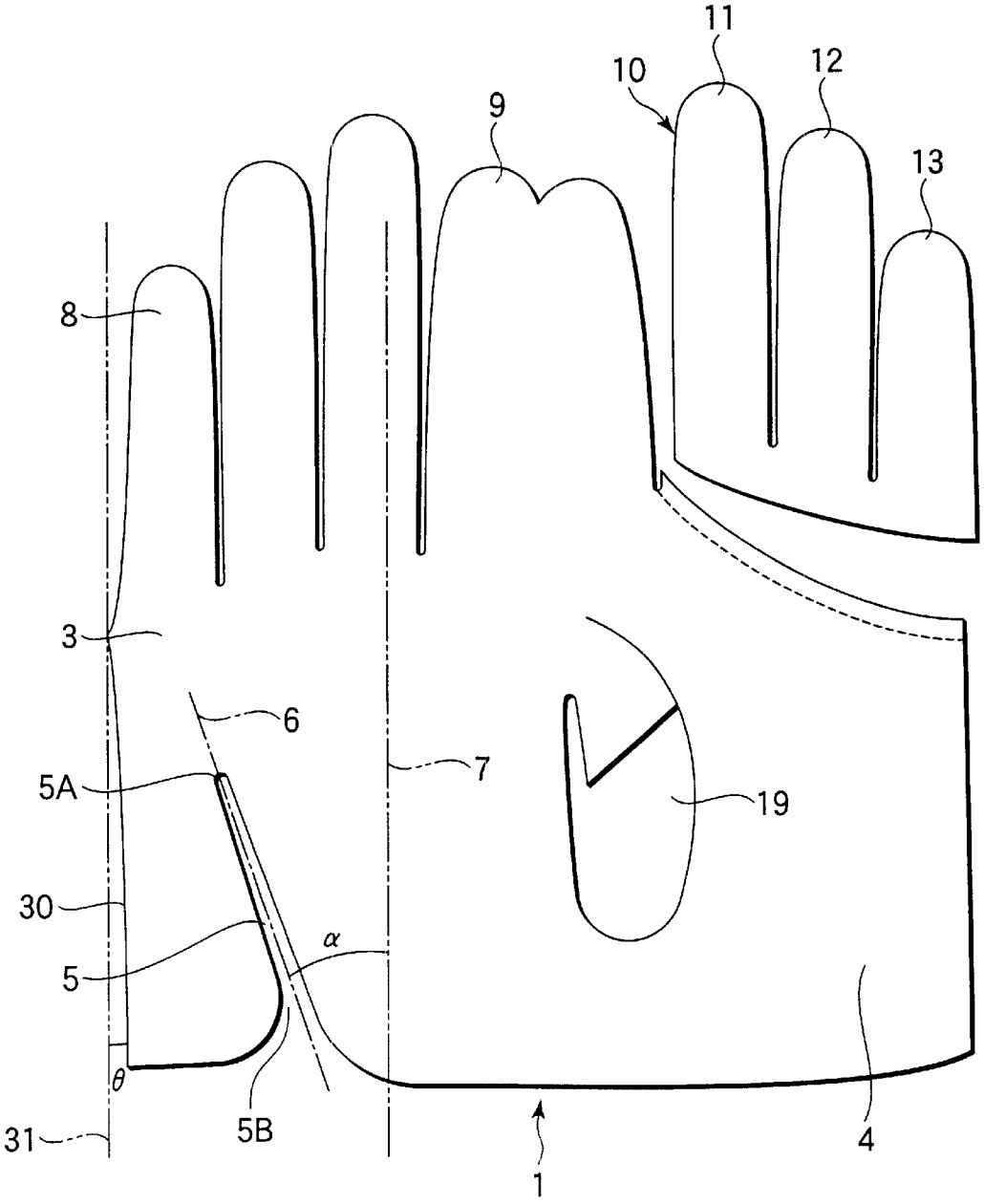
FIG. 1 is a development view showing an example of a pre-cut body of a golf glove according to the invention in a state where the body has not yet been sewn.
Figure 2:
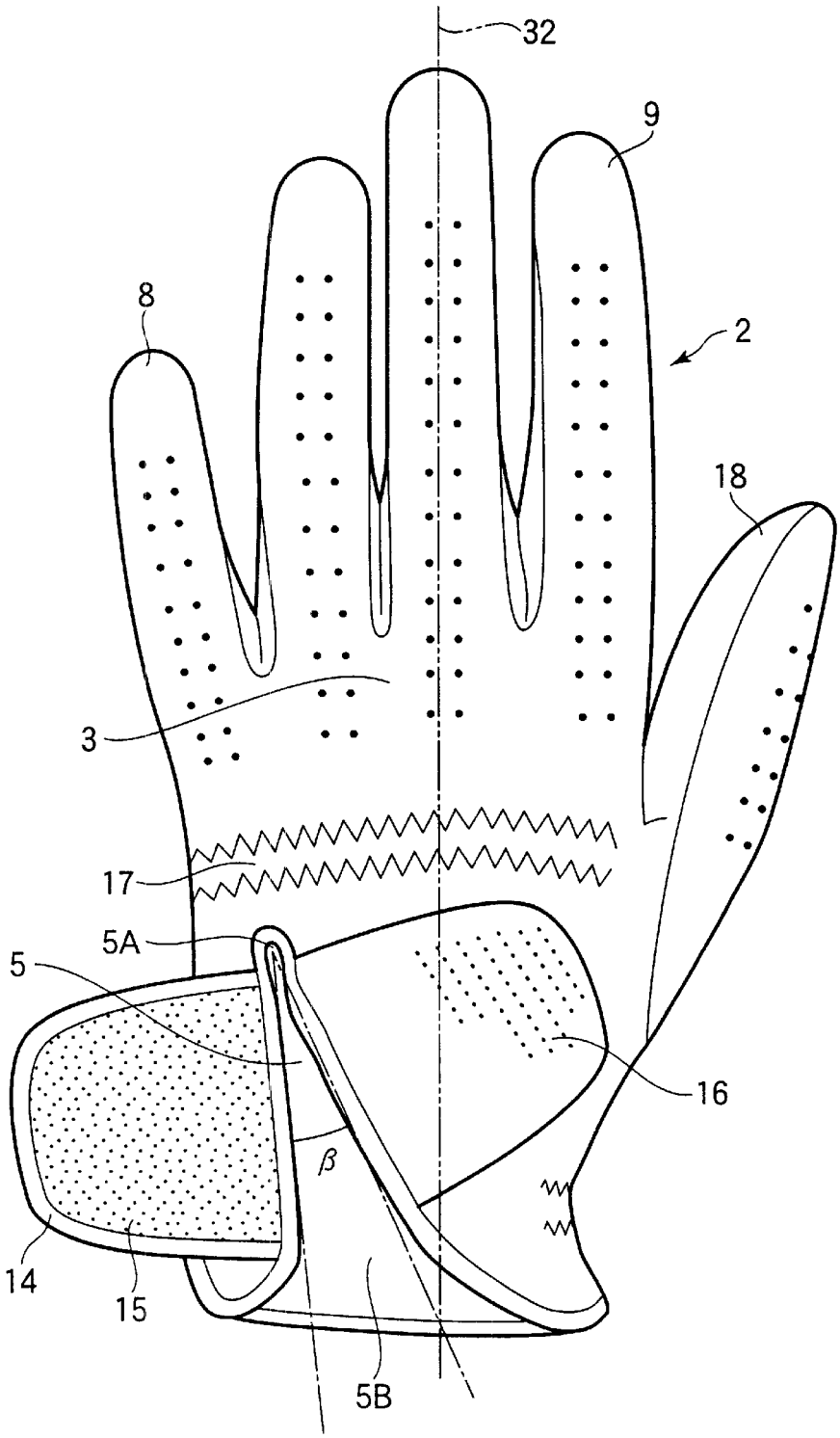
FIG. 2 is a perspective view showing an example of the golf glove according to the invention which is obtained by sewing the pre-cut body shown in FIG. 1 along predetermined sewing lines, and in which the slit is expanded.
Figure 3:
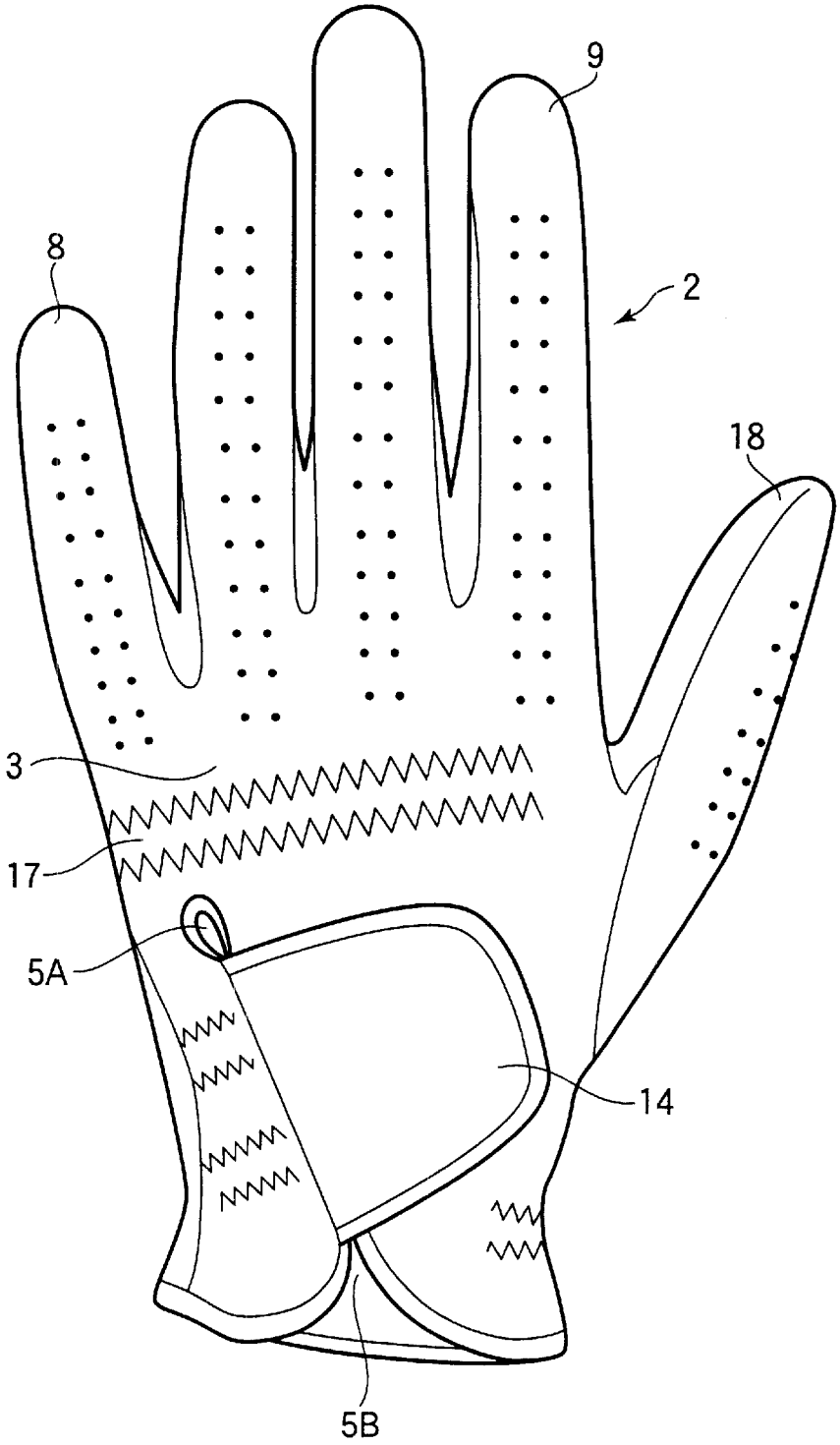
FIG. 3 is a perspective view showing an example of a state where the slit of the golf glove according to the invention is closed by a pair of engaging portions.
Figure 4:
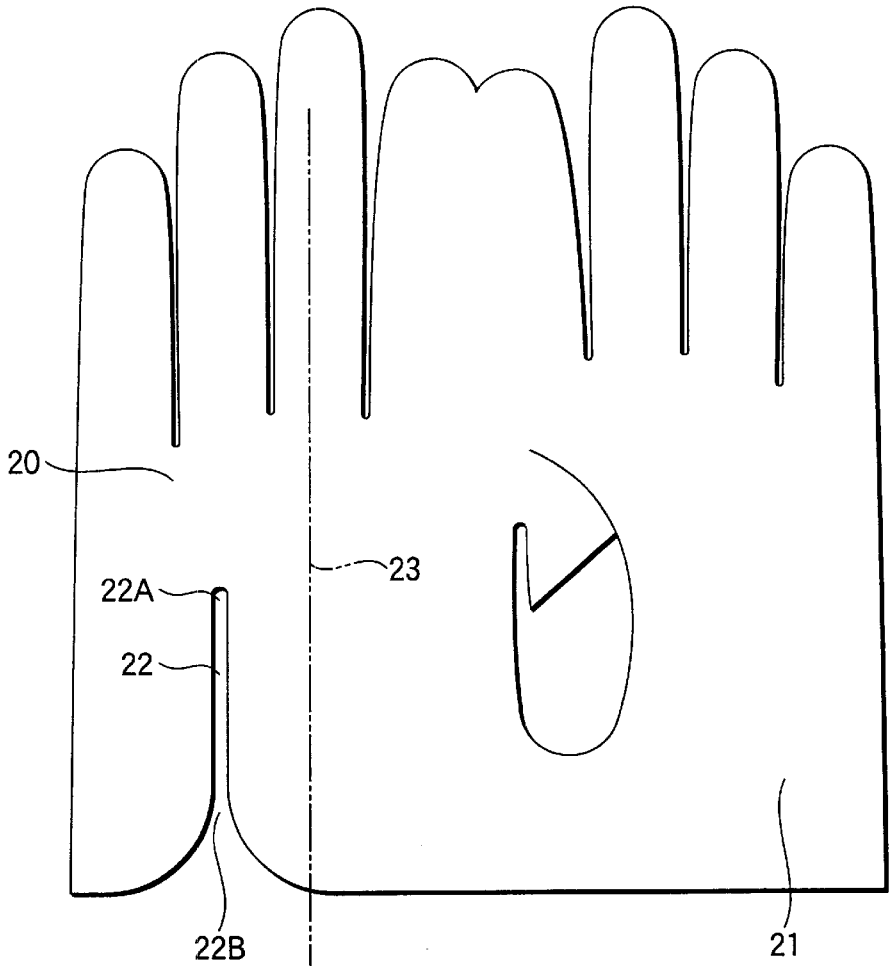
FIG.4 PRIOR ART
FIG. 4 is a development view showing an example of a pre-cut body of a golf glove according to the related art in a state where the body has not yet been sewn.

FIG. 1 is a development view showing an example of a pre-cut body of a golf glove according to the invention in a state where the body has not yet been sewn. In the figure, a gusset piece, a thumb piece, and the like which are necessary for obtaining a finished product are not shown. FIG. 2 is a perspective view showing an example of the golf glove according to the invention which is obtained by sewing the pre-cut body shown in FIG. 1 along predetermined sewing lines, and in which the slit is expanded, and FIG. 3 is a perspective view showing an example of a state where the slit of the golf glove is closed by a pair of engaging portions.

In the figures, 1 denotes the pre-cut body which constitutes the glove body 2, and which has not yet been sewn, 3 denotes a back region of the pre-cut body 1 which will be used for covering the back of a hand of a golfer, and 4 denotes a palm region which will be used for covering the palm of the hand of the golfer. As the material of the pre-cut body 1, a suitable material such as natural leather, synthetic leather, or artificial leather may be used. In the pre-cut body 1 of the illustrated embodiment, the back region 3 and the palm region 4 are not separated from each other but integrated with each other. It is a matter of course that the body may be divided into the back region 3 and the palm region 4 with setting the vicinity of a center of an index-finger portion 9 as a border.

The reference numeral 5 denotes the slit for laterally opening a lower portion of the back region 3 when a hand is inserted into the glove body 2 which has been sewn. In the slit 5, an imaginary line 6 connecting a top portion 5A and a bottom portion 5B of the slit does not coincide with a longitudinal axis 7 (a center line of the middle-finger portion) of the back region 3 of the glove body 2, but is inclined so that the top portion 5A of the slit 5 is close to a little-finger portion 8 of the back region 3 and the bottom portion 5B of the slit 5 is close to the index-finger portion 9 of the back region 3. The slit 5 has an inverted V-like shape in which the cutting width is gradually increased as advancing from the top portion 5A toward the bottom portion 5B as shown in FIG. 1. A side edge 30 of the back region 3 is cut so as to have an angle θ with respect to a longitudinal axis 31, which is parallel to the longitudinal axis 7 (that is, the side edge 30 is not parallel to the longitudinal axis 31). It is preferable that the angle θ is in a range of 1° to 52°.

From results of various experiments, it was found that the angle of the inclination of the slit 5 (that is, the angle a between the imaginary line 6 and the longitudinal axis 7) is optimally set to be in a rage of 5° to 40°, preferably, 15° to 30° with respect to the longitudinal axis 7 of the back region 3. When the angle of the inclination of the slit 5 is smaller than 5°, the slit is closer to the longitudinal axis 7 so that the expected effect cannot be attained. When the angle is set to be 40° or more, the inclination with respect to the longitudinal axis 7 is so excessive that a slit adequate for expanding an opening portion in the back region 3 cannot be formed.

In the figures, 10 denotes a finger piece portion constituting a middle-finger portion 11, a ring-finger portion 12, and a little-finger portion 13 which are to be formed on a side of the palm of a hand of a golfer. In order to, before sewing, previously remove away excess portions in the palm region 4 which is to be inward folded when the golfer grips a club, the finger piece portion 10 is separated from the pre-cut body 1.

In other words, in gripping, slacks due to the excess portions may be formed in the vicinities of root areas of the middle-finger portion 11, the ring-finger portion 12, and the little-finger portion 13. In order to prevent such slacks from occurring, the palm region 4 of the pre-cut body 1 is produced without forming the finger piece portion 10, and the finger piece portion 10 which is separately produced, and in which excess portions in the vicinities of the root areas are previously cut away is then sewn to a predetermined place of the palm region 4. According to this configuration, it is possible to prevent slack from occurring in gripping in the vicinity of the root area of the finger piece portion 10.

In the figures, 14 denotes an engaging tongue piece which is sewn along one peripheral portion of the slit 5 that is inclinedly formed as described above. A hook-and-loop fastener 15 in which, for example, many female engaging pieces are implanted is attached to the inner side of the engaging tongue piece 14 (that is, the hook-and-loop fastener 15 may be a female VELCRO). The reference numeral 16 denotes another hook-and-loop fastener which is sewn to the back region 3 continuous to the other peripheral portion of the slit 5, and in which, for example, many male engaging pieces are implanted (that is, the hook-and-loop fastener may be a male VELCRO). When the hook-and-loop fastener 15 (female VELCRO) of the engaging tongue piece 14 is engagingly fastened with the hook-and-loop fastener 16 (male VELCRO) disposed in the back region 3, the slit 5 which inclinedly elongates can be easily closed without performing forcible operation. Incidentally, the hook-and-loop fastener 16 (male VELCRO) is sewn to the back region 3 so as to be oblique with respect to a longitudinal axis 32 (a center line of the middle-finger portion). The reference numeral 17 denotes a flat rubber band for gathering components sewn to the inner side of the back region 3, and 18 denotes a thumb portion sewn to a through hole 19 which is opened in the pre-cut body 1.

In the golf glove according to the invention, as described above, the imaginary line 6 connecting the top portion 5A and the bottom portion 5B of the slit 5 does not coincide with the longitudinal axis 7 of the back region 3 of the glove body 2, and the slit 5 is formed so as to inclinedly elongate. In a usual usage manner, therefore, when the engaging tongue piece 14 is pulled up in an obliquely upward direction to be engagingly fastened with the hook-and-loop fastener 16 (male VELCRO), a state where right and left components does not overlap with each other is attained. As a result, an excellent sense of fitness is produced when a hand is inserted into the glove.

Since the slit 5 is formed so as to inclinedly elongate, the opening which is formed when a hand is to be inserted into the glove body 2 is larger than that which is formed in a golf glove according to the related art, and hence insertion and extraction of a hand can be smoothly performed. In the case where the slit 5 is formed so as to have an inverted V-like shape in which the cutting width is gradually increased as advancing from the top portion 5A toward the bottom portion 5B, the golf glove is provided with further ease of use. In this case, the slit 5 cuts the back region 3 of the glove body 2 from the bottom portion 5B to the top portion 5A in a approximately straight manner. However, the bottom portion 5B of the slit and the bottom of the back region 3 are connected in a curved manner. It is preferable that an angle β of the inverted V-like shape of the slit 5 as shown in FIG. 2 is in a range of 3° to 30°, more preferably in a range of 5° to 20°. When the angle β is small (less than 3°), it is difficult to secure the wrist and thus little sense of fitness is provided. If the angle β is large (more than 30°), when the wrist is secured, the back of the hand is undesirably contacted with the female engaging portions of the hook-and-loop fastener 15.

In the case where, in addition to the above-mentioned configuration, the configuration in which the finger piece portion 10 where excess portions are previously cut away is sewn to the palm region 4 is employed, it is possible to eliminate slacks which may be formed in gripping in the vicinity of the root area of the finger piece portion of the palm region 4, whereby the sense of fitness can be further improved.

As described above, in the golf glove according to the invention, a hand can be smoothly inserted and extracted as compared with a golf glove according to the related art. In the case where a slit is formed so as to have an inverted V-like shape in which the cutting width is gradually increased as advancing from the top portion toward the bottom portion, when a hand is to be inserted, the slit is sufficiently laterally expanded, and hence insertion and extraction can be performed very smoothly as compared with a golf glove according to the related art. Also an engaging tongue piece configured by a hook-and-loop fastener or the like which is sewn along the peripheral portion of the slit inclinedly elongates. When the engaging tongue piece is to be engagingly fastened with another hook-and-loop fastener or the like attached to the back region in the vicinity of the slit, therefore, each of components constituting two portions of the back region that is laterally split by the slit can be prevented from being overlapped with each other, and hence a sense of fitness when a person wears the glove is further improved.

In the case where, in addition to the configuration in which the slit formed in the back region inclinedly elongates as described above, a configuration in which excess portions in vicinities of root areas of the middle-finger piece, the ring-finger piece, and the little-finger piece among components constituting the palm region of the glove body are previously removed away before sewing is employed, the two improvements cooperate with each other so as to obtain an excellent sense of fitness as a whole.

What is claimed is:

1. A golf glove comprising:

a back region of a glove body formed with a slit, which is laterally expanded when a hand is inserted, at a lower end portion thereof; and a pair of engaging portions for closing the slit after the hand is inserted, the engaging portions provided at peripheral portions of the slit, respectively; and a finger portion including a thumb piece, an index-finger piece, a middle-finger piece, a ring-finger piece, and a little-finger piece, wherein an imaginary line connecting top and bottom portions of the slit is not parallel to a longitudinal axis of the back region of the glove body;

the longitudinal axis passes through a center of the middle finger piece;

the top portion of the slit is close to a little-finger portion of the back region;

the bottom portion of the slit is close to an index-finger portion of the back region;

one of the engaging portions is attached to the back region of the glove body to be inclined with respect to the longitudinal axis; and the slit has an inverted V-like shape in which a cutting width is gradually increased as advancing from the top portion toward the bottom portion.

2. The golf glove according to claim 1, wherein a side edge of the back region close to the little-finger portion is inclined with respect to the longitudinal axis.

3. The golf glove according to claim 1, wherein an angle between the imaginary line and the longitudinal axis is in a range of 5° to 40°.

4. The golf glove according to claim 1, wherein the inverted V-like shape has an angle in a range of 30° to 30° therein.

* * * * *